US006965106B2

(12) United States Patent
Ding et al.

(10) Patent No.: US 6,965,106 B2
(45) Date of Patent: Nov. 15, 2005

(54) METHOD FOR DISSOCIATING IONS USING A QUADRUPOLE ION TRAP DEVICE

(75) Inventors: Li Ding, Sale (GB); Michael Sudakov, Sale (GB)

(73) Assignee: Shimadzu Research Laboratory (Europe) Ltd., Manchester (GB)

( * ) Notice: Subject to any disclaimer, the term of this patent is extended or adjusted under 35 U.S.C. 154(b) by 0 days.

(21) Appl. No.: 10/487,506

(22) PCT Filed: Aug. 23, 2002

(86) PCT No.: PCT/GB02/03886

§ 371 (c)(1),
(2), (4) Date: Apr. 1, 2004

(87) PCT Pub. No.: WO03/021631

PCT Pub. Date: Mar. 13, 2003

(65) Prior Publication Data

US 2004/0232328 A1 Nov. 25, 2004

(30) Foreign Application Priority Data

Aug. 31, 2001 (GB) ..... 0121172

(51) Int. Cl.[7] ..... H01J 49/42

(52) U.S. Cl. ..... 250/292; 250/282

(58) Field of Search ..... 250/281, 282, 250/292, 291, 290

(56) References Cited

U.S. PATENT DOCUMENTS 6,545,268 B1 * 4/2003 Verentchikov et al. ..... 250/281
2004/0079875 A1 * 4/2004 Ding ..... 250/282

FOREIGN PATENT DOCUMENTS

WO WO 00/77824 12/2000
WO WO 01/29875 4/2001

OTHER PUBLICATIONS

Lammert et al., Surface–induced Dissociation of Molecular Ions in a Quadrupole Ion Trap Mass Spectrometer, Journal of the American Society for Mass spectrometry, 1991, pp. 487–491, vol. 2.

Ding et al., Ion Motion in the Rectangular Wave Quadrupole Field and Digital Operation Mode of a Quadrupole Ion Trap Mass Spectrometer, Chinese Vacuum. Science and Technology, 2001, pp. 176–181, vol. 11.

Sudakov, et al., Excitation Frequencies of Ions Confined in a Quadrupole Field with Quadrupole Excitation, Journal of the American Society for Mass Spectrometry, 2000, pp. 11–18, vol. 11.

Konenkov et al., Matrix Methods for the Calculation of Stability Diagrams in Quadrupole Mass Spectrometry, Journal of The American Society for Mass Spectrometry, 2002, pp. 597–613, vol. 13.

Zhong et al., Tandem Fourier Transform Mass Spectrometry Studies of Surface Induced Dissociation of Benzene Monomer and Dimer Ions on a Self–Assembled Fluorinated Alkanethiolate Monolayer Surface, Analytical Chemistry, 1997, pp. 2496–2503, vol. 69.

(Continued)

*Primary Examiner*—Jack I. Berman
(74) *Attorney, Agent, or Firm*—Leydig, Voit & Mayer, Ltd

(57) ABSTRACT

A method of trapping ions using a quadrupole ion trap device includes applying quadrupole excitation to trapped precursor ions causing them to be driven into the ring electrode where they undergo surface induced dissociation. The resultant product ions are then trapped within the ion trap device.

36 Claims, 7 Drawing Sheets

OTHER PUBLICATIONS

Collings et al., Observation of Higher Order Quadrupole Excitation Frequencies in a Linear Ion Trap, Journal of the American Society for Mass Spectrometry, 2000, pp. 1016–1022, vol. 11.

Paradisi, Boundary Effects and Collisional Activation in a Quadrupole Ion Trap, Organic Mass Spectrometry, 1992, pp. 251–254, vol. 27.

Lammert et al., Pulsed Axial Activation in the Ion Trap: A New Method for Performing Tandem Mass Spectroscopy (MS/MS), Rapid Communications in Mass Spectrometry., 1992, pp. 528–530, vol. 6.

Danell et al, "A New Approach for Effecting Surface–Induced Dissociation in an Ion Cyclotron Resonance Mass Spectrometer: A Modeling Study" Journal of the American Society for Mass Spectrometry, Elsevier Science Inc., New York, Dec. 2000, pp. 1107–1117, vol 11.

Liere et al: Resonance Excitation in a Quadrupole Ion Trap: Modification of Competing Dissociative Channel Yields International Journal of Mass Spectrometry and Ion Processes, 1996, pp. 101–117, vol. 153, Elsevier Scientific Publishing Co.

* cited by examiner

METHOD FOR DISSOCIATING IONS USING A QUADRUPOLE ION TRAP DEVICE

FIELD OF THE INVENTION

This invention relates to quadrupole mass spectrometry. In particular, the invention relates to methods of ion dissociation in a radio frequency quadrupole ion trap device.

BACKGROUND OF THE INVENTION

Tandem mass spectrometry or MS/MS is a method which includes dissociation of selected precursor ions followed by mass analysis of the resultant product ions. MS/MS can be used to identify a precursor ion and determine its structure. It is commonly used for structural analysis of a wide variety of compounds, including peptides, proteins and oligopeptides.

In practice, tandem mass spectrometry apparatus includes means for selecting precursor ions, means for dissociating the selected precursor ions and means for further mass analysis of the resultant product ions. Several different design approaches may be adopted for this purpose. Some designs, such as those based on triple quadrupole (TQ), magnetic sector, or time of flight (ToF), require separate instrumentation dedicated to carrying out the respective function at each successive stage of the MS/MS process. However, the most attractive design for tandem mass spectrometry is based on a quadrupole radio frequency ion trap (QIT). A QIT can be used to select precursor ions and confine the selected ions within a defined spatial volume, enabling one or more stages of dissociation and product ion analysis to be carried out. Methods such as collisionally induced dissociation (CID) and photo dissociation (PD) have been used to dissociate precursor ions in an ion trap device. Surface induced dissociation (SID) is another dissociation technique whereby dissociation is brought about by collision of the ions with a surface. This technique has a relatively high dissociation efficiency, typically up to 50%.

Conventional methods for exciting ion motion in an ion trap device involve exciting the ion cloud in the axial direction only. Such excitation is commonly used as a method for heating the ion cloud to encourage CID. The maximum energy which can be released by the collision of an ion with a neutral molecule is a function of the masses of the two particles. When averaged over the Maxwellian distribution of buffer gas velocity, this energy $<E_{coll}>$ can be expressed as:

$$< E_{coll} >= \frac{3kT}{2} + \frac{M_b}{M_i} < K_i > \quad (1)$$

where T is the temperature of the buffer gas, $M_b$ and $M_i$ are the masses of the buffer gas molecule and of the ion respectively and $<K_i>$ is the average kinetic energy of the ion. The kinetic energy of ions in the ion trap device is limited. It follows from equation (1), that the CID process is ineffective for heavy ions. By contrast, the total kinetic energy of an ion may be transformed into internal degrees of freedom when the ion collides with an electrode surface. Thus, the SID process, which exploits such collisions has the advantage that its effectiveness is not constrained by the mass of the precursor ion.

Excitation of the ion cloud in the axial direction is unsuitable when SID is being used because the end cap electrodes at which collisions would occur have entrance and exit holes reducing the effectiveness of the process. It is preferable to induce collisions at the ring electrode.

SUMMARY OF THE INVENTION

As described in "Surface-induced Dissociation of Molecular Ions in a Quadrupole Ion Trap Mass Spectrometer", by Lammert S. A. et al, Journal of The American Society for Mass Spectrometry, 1991, vol. 2, pp. 487–491 a short DC pulse excitation technique has been used to bring about SID at the ring electrode of an ion trap device. The applied DC pulse destabilises the motion of precursor ions for a short time enabling the ions to receive energy from the trapping field and to collide with the ring electrode. This experiment has shown that, in principle, it is possible accomplish SID in an ion trap device, although the total efficiency achieved was not high.

The method of this invention utilises radial excitation of the ion cloud by means of quadrupole excitation. This enables SID to take place in a quadrupole ion trap device due to collisions at the ring electrode. Total efficiency of dissociation and of the fragment collection process is found to be considerably higher than that achieved using the aforementioned short DC pulse excitation technique.

According to one aspect of the invention there is provided a method for dissociating precursor ions and for trapping the resultant product ions using a quadrupole ion trap device having a pair of end cap electrodes and a ring electrode, the method including the steps of generating a quadrupole electric field to trap said precursor ions in the ion trap device and applying quadrupole excitation to the trapped precursor ions, said quadrupole electric field and said quadrupole excitation being such that the trapped precursor ions are resonantly driven onto the ring electrode where they undergo surface induced dissociation creating said product ions which are then trapped within the ion trap device.

According to another aspect of the invention there is provided a quadrupole ion trap device for trapping product ions formed by dissociation of precursor ions, comprising a pair of end cap electrodes, a ring electrode, drive means for generating a quadrupole electric field effective to trap said precursor ions in an ion trapping volume of the ion trap device and excitation means for applying quadrupole excitation to the trapped precursor ions, whereby the trapped precursor ions are resonantly driven onto the ring electrode where they undergo surface induced dissociation creating said product ions which are then trapped in said ion trapping volume.

The quadrupole excitation causes instability of the radial component of motion of the trapped precursor ions such that radial excursions of the ions towards the ring electrode grow resonantly until collision occurs. In this situation, the a,q parameters representing stability of ion motion in an ion trap device lie within a resonance band $\beta_r$ of the well known (a–q) stability diagram.

The quadrupole excitation can be generated in a number of different ways. One approach is to modify the fundamental drive voltage which is applied to the ion trap device to generate the quadrupole electric field e.g. by a periodic modulation of one or more of duty cycle, amplitude and phase of the drive voltage. The drive voltage may have a rectangular or harmonic waveform.

Alternatively, quadrupole excitation can be generated by applying an additional periodic AC excitation voltage to the ring electrode or to the end cap electrodes.

BRIEF DESCRIPTION OF THE DRAWINGS

Embodiments of the invention are now described, by way of example only, with reference to the accompanying drawings, of which.

DETAILED DESCRIPTION OF THE INVENTION

Figure 1A:
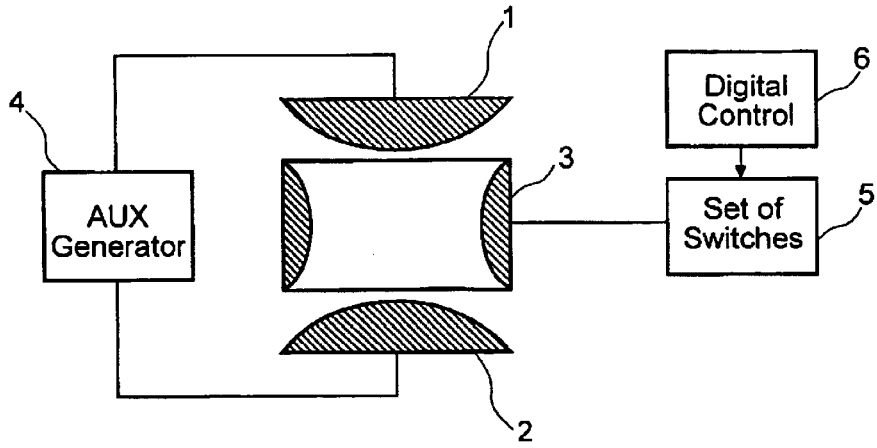
FIG. 1(*a*) shows a quadrupole ion trap device having a digital drive arrangement, FIG. 1(*b*) shows a quadrupole ion trap device having a harmonic RF drive arrangement.

The subject invention relates to a technique for enabling SID to be used in a quadrupole ion trap device. In embodiments that are to be described, a 3D quadrupole radio frequency ion trap device is used for ion trapping. Precursor ions are injected into, or are created inside, the ion trap device using known technology and a buffer gas is used for collisional cooling of the ion motion. In preferred embodiments, unwanted ions are removed by means of appropriate mass-selective excitation methods or scanning technology so that only one precursor ion population remains in the ion trap device before the dissociation process begins. The work point (i.e. the value of q in the (a–q) stability diagram) of the precursor ions is moved to a selected point at which resonance of the ions' radial excursions will occur when the quadrupole excitation is applied, or the work point of the precursor ions is moved to this point of resonance by means of scanning technology, while the quadrupole excitation is being applied. Such parametric resonance causes an exponential increase of the radial trajectories of the precursor ions, until the ions collide with the ring electrode where surface induced dissociation takes place. The resultant product (or fragment) ions are trapped inside the ion trap device for mass analysis or for further stages of dissociation.

The quadrupole excitation may be produced by a periodic modification to the shape of the fundamental drive voltage at a frequency which is an integral fraction of the main drive frequency whereby to cause quadrupole excitation of the radial motion of the ions in resonance with the excitation field. The parametric resonance of the radial motion results in an exponential increase of the radial size of ion trajectory causing the ions to collide with the ring electrode. For positively charged precursor ions, collisions occur when the voltage at the ring electrode is positive and this is the optimal moment for trapping the resultant product ions. The waveform of the drive voltage is such that the voltage at the ring electrode changes from attractive to retarding each half period and so the product ions are effectively removed from the surface of the ring electrode by the drive potential. By this means, both high efficiency SID and improved trapping efficiency of the product ions are achieved in the quadrupole ion trap device thereby enhancing the analytical utility of the mass spectrometer. In a preferred embodiment, a periodic rectangular waveform (RWF) drive voltage is used and instability of the ion's radial motion is brought about by modifications to the shape of this waveform. The shape of the RWF is periodically modified every four pulses in such a way that each second positive pulse is made wider, and each fourth pulse is made narrower. This kind of excitation will be referred to as "asymmetric second period modulation" (A2M). By this means, both the fundamental drive voltage and the quadrupole excitation can be implemented using a single waveform.

In an alternative embodiment, at least one AC excitation voltage, which can be any periodic time—varying voltage, can be applied to the end cap electrodes or to the ring electrode together with the drive voltage, which can also be any periodic time-varying function. This additional AC excitation voltage creates a time-varying quadrupole electrical field inside the trapping volume of the ion trap device, causing parametric resonance of the radial motion of the precursor ions under certain trapping conditions. As a result, the precursor ions are caused to collide with the ring electrode, leading to SID.

In another alternative embodiment, radial instability of ion motion is achieved by means of a periodic rectangular waveform drive voltage having a duty cycle d<0.5 (i.e. a positive pulse shorter than negative). This waveform modifies the stability diagram of ion motion and it also gives rise to a negative DC voltage at the ring electrode. This causes the radial component of ion motion to become unstable for positive ion if the ion mass is higher or equal to the mass of the precursor ion. As a result, collisions of precusor ions with the ring electrode occur, leading to SID. In this method the ion trap device provides the trapping conditions for a limited mass range of product ions, that have a mass-to-charge ratio less than that of the precursor ions.

Figure 1B:
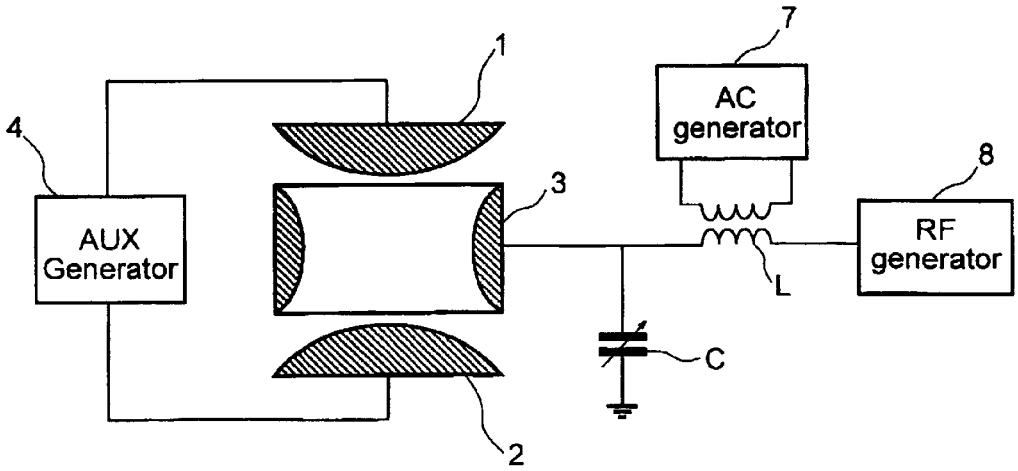

FIGS. 1(*a*) and 1(*b*) show two alternative quadrupole ion trap devices that can be used to implement the present invention. Both devices have a pair of end cap electrodes 1,2, a ring electrode 3 and an auxiliary voltage generator 4 connected across the end cap electrodes 1,2. Typically, each end cap electrode has an aperture by which ions can be injected into, or ejected from the ion trap device. The auxiliary voltage generator 4 can be used to facilitate a range of different operational functions including ion ejection and mass-selective scanning. Typically, the auxiliary voltage generator 4 is arranged to supply an AC and/or a DC voltage to the end cap electrodes 1,2 and can be used to generate an AC dipole field having a single frequency or a more complex spectrum of frequencies.

FIG. 1(*a*) shows a typical digital drive arrangement which is used to apply a periodic rectangular waveform drive (or trapping) voltage to the ring electrode 3. The digital drive arrangement comprises a digital control unit 6 for controlling the timing of a set of switches 5 arranged to switch alternately between high and low level voltages (not shown), whereby to generate the required rectangular waveform drive voltage at the ring electrode 3. An example of this kind of digital drive arrangement is described in PCT Publication No. WO 0129875. As will become clear hereinafter, the timing of the switches can be controlled with high precision (typically better than 0.1%) to generate a rectangular waveform drive voltage having a constant or rapidly changing duty cycle. In particular, this arrangement is well suited to generate a rectangular waveform drive voltage having a modulated duty cycle; for example, an asymmetrically N-modulated waveform.

FIG. 1(*b*) shows a typical drive arrangement which is used to apply a harmonic waveform RF drive voltage to the ring electrode 3. In this case, the drive arrangement comprises a RF generator 8 coupled to an LC-resonant circuit. The drive arrangement comprises a RF generator 8 coupled to an LC resonant circuit. The drive arrangement also has an auxiliary AC generator 7 which can be used to generate an additional AC excitation voltage and/or modulate the RF drive voltage.

It will be appreciated that the quadrupole ion trap devices shown in FIGS. 1(*a*) and 1(*b*) are merely illustrative of a wide range of quadrupole ion trap arrangements known in the art. For example, the ion trap device may be a 3-D cylindrical ion trap device or a 3-D hyperboloid ion trap device.

During normal operation, the duty cycle of the RWF drive voltage is constant. This provides a trapping field inside the ion trap device, which is effective to trap externally injected ions over a predetermined M/Z range of interest. A DC offset voltage can be applied to both end cap electrodes and to the ring electrode using a DC voltage source. An auxiliary AC voltage produced by auxiliary voltage generator 4,7 may also be applied to both end cap electrodes and to the ring electrode. Accordingly, the voltage applied to the ring electrode may be the sum of a drive voltage; a DC offset voltage and an AC voltage and the voltage applied to the end cap electrodes may be the sum of a DC offset voltage and an AC voltage.

The ring electrode may have a surface treatment to assist surface induced dissociation. This may take the form of a gold plated surface layer or an organic monolayer thin film.

Ion Trapping and Quadrupole Excitation

The electrode system of the ion trap device is cylindrically symmetric. It is impossible to create a dipole electric field in the radial direction, unless the ring electrode is split into two parts. Stability or otherwise of ion motion in the ion trap device can be represented by a stability diagram in the (a,q) plane. As described by Ding L. et al in "Ion motion in the Rectangular Wave Quadrupole Field and Digital Operation Mode of a Quadrupole Mass Spectrometer", Chinese Vac. Sci. and Techn., 2001, vol. 11, pp. 176–181, the parameters a and q for a periodic rectangular waveform drive voltage are given by the expressions:

$$a = \frac{8Z_i U}{M_i \Omega^2 (0.5r_0^2 + z_0)^2} \quad U = -dV_1 - (1-d)V_2 \tag{2}$$

$$q = \frac{4Z_i V}{M_i \Omega^2 (0.5r_0^2 + z_0^2)} \quad V = 2d(1-d)(V_1 - V_2) \tag{3}$$

where $\Omega=2\pi/T$ is the angular frequency of the drive voltage, $V_1$ and $V_2$ are the amplitudes of the positive and negative pulses of the RWF, d is the duty cycle defined as the duration of the positive voltage $V_1$ divided by T, $M_i$ and $Z_i$ are the mass and charge of the ion, $r_0$ is the inscribed radius of the ring electrode and $2z_0$ is the distance between the end cap electrodes. The most suitable regime for ion trapping is the RF only regime, for which the DC component of the trapping voltage is zero i.e. U=0 and a=0. For a square wave, the duty cycle d equals 0.5 and so the RF only regime for a square wave voltage requires that $V_1=-V_2$. The most important parameter for representing ion motion in an ion trap device is the fundamental secular frequency of the ion vibration. In a quadrupole ion trap ions have two secular frequencies: radial secular frequency $\omega_r$, which is the same for motion in the x- and y-directions, and axial secular frequency $\omega_z$. Both of these frequencies are less (inside the first stable region) than one half of the drive frequency $\Omega$. Ion motion within the ion trap device can be characterized by so-called stability parameters: $\beta_z=2\omega_z/\Omega$ and $\beta_r=2\omega_r/\Omega$. Calculations show, that in the RF only regime of an ion trap device driven by a square waveform drive voltage, the stability parameters vary as follows: $\beta_z$ from 0 up to 1.0, and $\beta_r$ from 0 up to 0.338.

Resonance Conditions in the Case of Modulation Resonance

Charging of the ring electrode or of both end cap electrodes results in a quadrupole field. Any periodic time-varying waveform may be used as a drive voltage for trapping ions. An auxiliary AC excitation voltage may be applied simultaneously with the drive voltage. This auxiliary voltage may have a frequency different from the fundamental frequency of the drive voltage. Actually, quadrupole excitation does not require application of auxiliary AC voltages because, as has been described, parametric resonance may also be achieved by any kind of modulation (e.g. amplitude, phase or duty cycle modulation) of the fundamental drive voltage. Resonance of the ion motion due to a general quadrupole excitation results in parametric resonance instability of the ion motion. Quadrupole resonance causes ion motion instability at certain values of the stability parameter $\beta$, represented by resonance bands shown unshaded in the (a–q) stability diagram of FIG. 3. In general, if the quadrupole excitation has a period N times that of the fundamental drive voltage, ion motion will become unstable within resonance bands having the values $\beta_{r,z}=k/N$, k=1,2 . . . N−1, as described by Sudakov M., et al in "Excitation Frequencies of Ions Confined in a Quadrupole Field with Quadrupole Excitation", Journal of The American Society for Mass Spectrometry, 2000, vol. 11, pp. 11–18).

Figure 2:
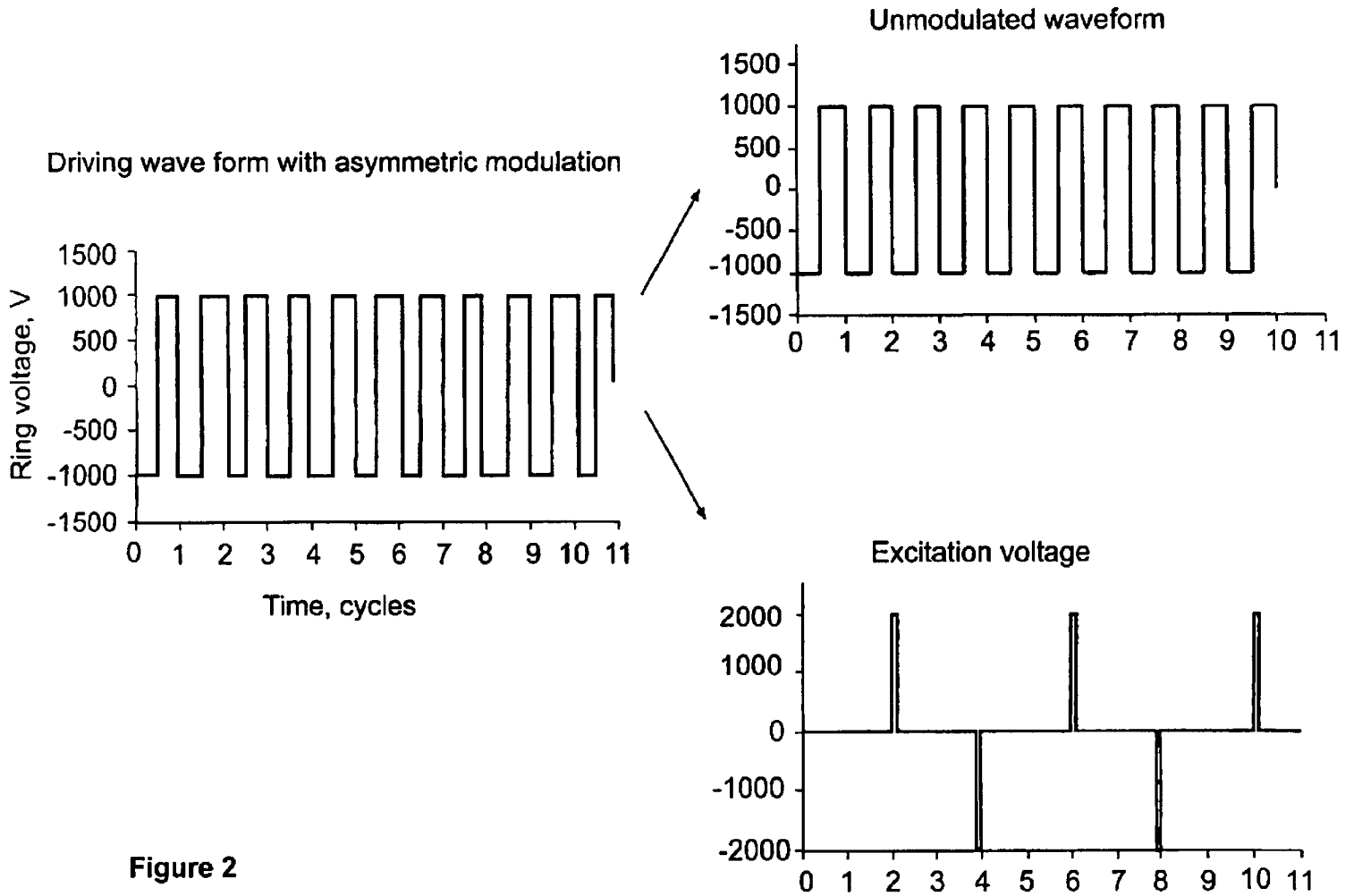
FIG. 2 shows an asymmetrically modulated rectangular waveform voltage and the equivalence of this kind of modulation to pulse quadrupole excitation, FIGS. 3(*a*) and 3(*b*) show (a–q) diagrams representing stability of ion motion in an ion trap device having A2M and A4M rectangular waveform drive voltages respectively.

As already described, quadrupole excitation can be conveniently accomplished by pulse width (i.e. duty cycle) modulation of a rectangular waveform drive voltage. The advantage of this approach is that it does not require application of any additional voltage—only the rectangular waveform drive voltage is needed. Several kinds of excitation scheme may be implemented by modulating the duty cycle of the main drive RWF. In order to excite radial ion motion, the most useful scheme is "asymmetric" modulation of every $N^{th}$ pulse, whereby the length of each successive $N^{th}$ positive (or alternatively negative) pulse is increased and decreased alternately. This kind of modulated waveform will be referred to hereinafter as an "asymmetrically N-modulated waveform" (ANM). One of the advantages of this form of excitation is that the modulated waveform does not have an average DC voltage. An A2M waveform (i.e. N=2) is shown in the left hand part of FIG. 2. This waveform may be expressed as the sum of an unmodulated square wave and a periodic sequence of positive and negative short pulses at each second period (see the right hand part of FIG. 2). The sequence of short pulses creates a quadrupole excitation with a period which is exactly 4 times larger than that of the fundamental rectangular wave drive voltage.

Figure 3A:
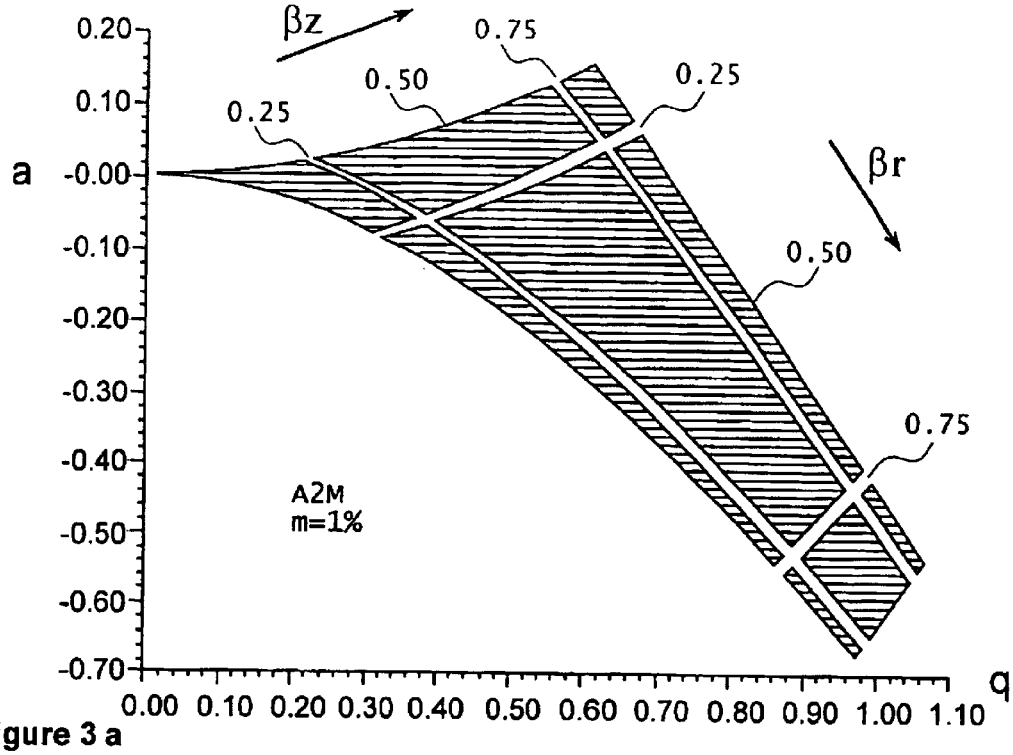
Figure 3B:
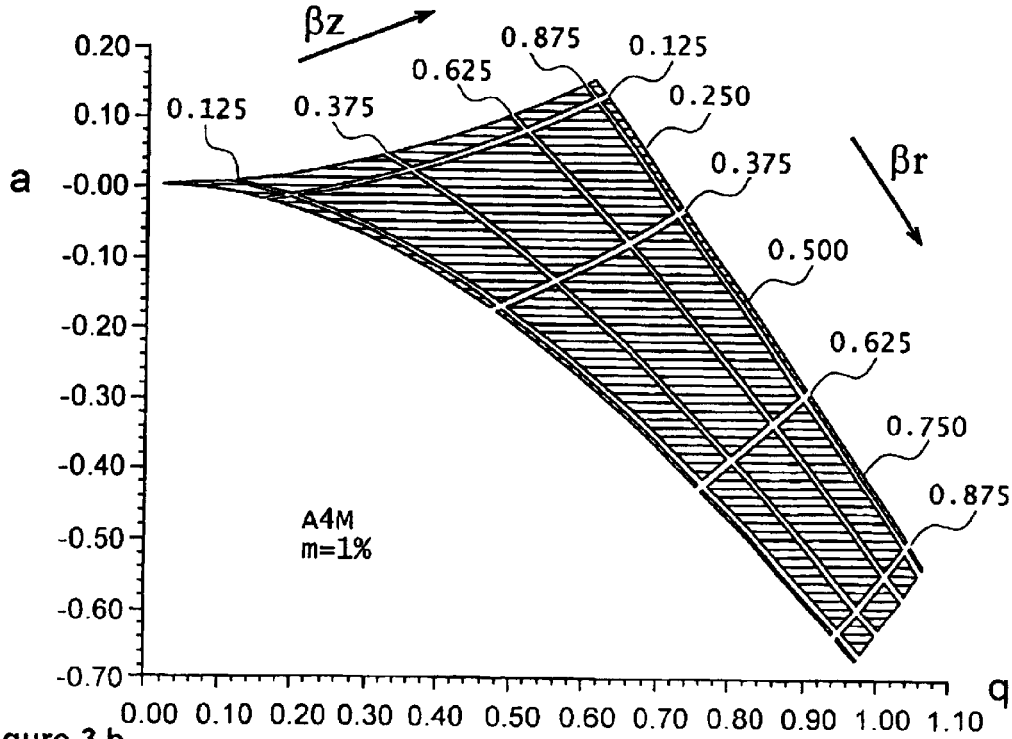

Computation of the (a–q) stability diagram of ion motion can be carried out by matrix methods as described by D. J. Douglas et al in "Matrix Methods for the Calculation of Stability Diagrams in Quadrupole Mass Spectrometry", Journal of The American Society for Mass Spectrometry, 2001. FIGS. 3(*a*) and 3(*b*) show (a–q) stability diagrams having resonance bands (shown unshaded) at particular values of $\beta_r$ and $\beta_z$ within which the radial and axial components respectively of ion motion are unstable. It follows from these Figures that ion motion may be excited in the radial direction using an ANM waveform independently of any axial resonance. More specifically, in the case of an A2M waveform (FIG. 3*a*) the resonance band at $\beta_r$=0.25 crosses the RF only line (a=o) at q=0.5386, and is well separated from the closest axial resonance bands at $\beta_z$=0.25 and $\beta_z$=0.75. Axial second order resonance at $\beta_z$=0.5 which crosses the RF only line at q=0.500 is absent. Therefore, it can be seen that by appropriately setting the value of q, resonance of the radial component of ion motion can be excited without also exciting resonance of the axial component of ion motion, which would otherwise reduce the number of precursor ions reaching the ring electrode. In the case of an A4M waveform (FIG. 3*b*), the first order radial resonance band at $\beta_r$=−0.125 crosses the RF only line at q=0.274 which, again, is well separated from the closest axial resonance bands $\beta_z$=0.125 and 0.375. Axial second order resonance at $\beta_z$=0.25 which crosses the RF only line at q=0.269 is absent.

It will be appreciated from the foregoing, an ANM waveform is especially useful for the excitation of radial parametric resonance independently of axial resonance. It uses the property that the axial secular frequency is two times higher than the radial secular frequency. Another important advantage gained by using the ANM waveform is that this waveform does not contribute any average DC component. The positions of resonance points along the q-axis for several different ANM waveforms are presented in Table 1.

It will be appreciated that although the above-described examples are based on the RF only regime in the (a,q) stability diagram, for which a=U=0, it is alternatively possible to use duty cycle modulation (e.g. ANM) to excite parametric resonance of the radial component of ion motion to cause SID at the ring electrode when the value of a is finite i.e. when the duty cycle d of the applied rectangular waveform drive voltage is not equal to 0.5 and/or the amplitude $V_1$, $V_2$ of the positive and negative pulses of the drive voltage are unequal.

In order to test the feasibility of these methods computer simulations of the ion motion have been carried out.

Simulations of Radial Parametric Resonance

Direct simulation of ion motion in a quadrupole ion trap device can be carried out using Simion 7.0 software. Such simulations have been performed for an ion mass $M_i$=3500 Da and a charge $Z_i$=2e. Parameters of the ion trap device used in the simulation include an inscribed radius of the ring electrode $r_0$=10 mm, and a half distance between the end cap electrodes $z_0$=7.71 mm (stretched geometry). The drive voltage used in the simulation was an A2M rectangular waveform voltage having positive and negative pulses of equal amplitude (1000V). In practice, ions will experience random collisions with buffer gas molecules, and the simulation software has been developed to take account of these collisions using a 3D hard-sphere model. In this simulation He was used as the buffer gas ($M_b$=4 Da) at a temperature of 300K. with an ion mean free path of 15 mm, which is characteristic of a pressure of 1 m Torr.

Simulation of the ion motion was carried out near the point of radial resonance, $\beta_r$=0.25 (3.2 $\mu$s<T<3.3 $\mu$s). When the duty cycle of modulation level ion is small (i.e. m<0.2%), the ion motion will be stable because energy gained from the excitation field is compensated by the energy lost due to collisions with molecules of the buffer gas. Ion motion will then be confined to a region inside the trapping volume of the ion trap device. When higher excitation levels are used the energy gained from the excitation field is greater than the energy lost to the buffer gas. Ion motion then becomes unstable in the radial direction, resulting in collisions with the ring electrode. As the modulation level increases, the energy of the ions at the time of collision with the ring electrode, and the width of the parametric resonance band also increase.

Simulations of Ion Collisions with the Ring Electrode

Figure 4:
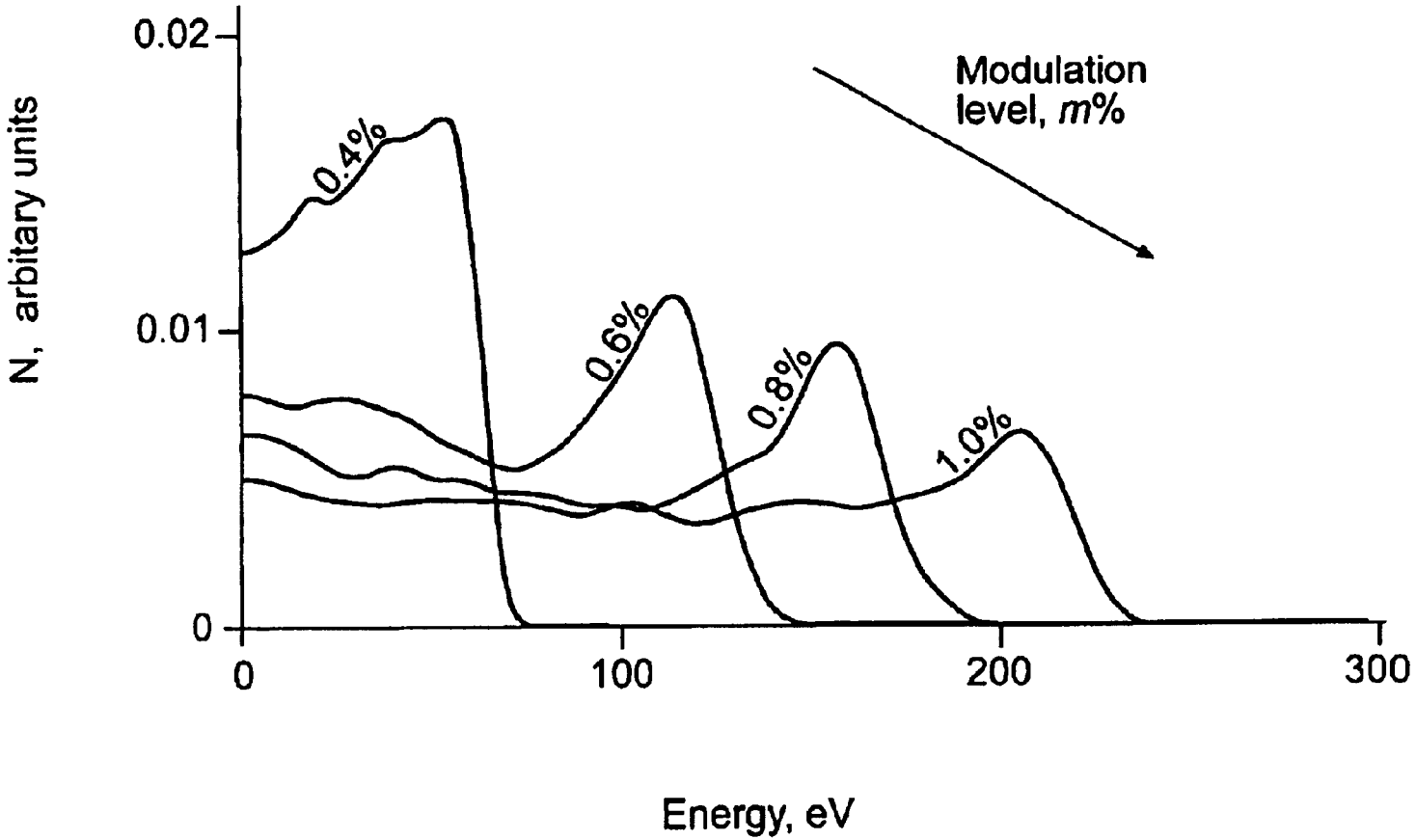
FIG. 4 illustrates the distribution of ion energy at the moment of ion collision with a ring electrode.

The described SID, results from instability of the radial component of motion of trapped precursor ions. Information about the collisions of the ions with the ring electrode can be derived by simulation. In simulations that have been carried out, the initial conditions of the ions correspond to the equilibrum space-velocity distribution of the ion cloud. This distribution was calculated beforehand using the aforementioned 3D-collision software. A simulation of the motion of each ion started from the initial random equilibrium condition in a trapping potential generated using the A2M modulation. The ion gains energy from the excitation field and so its trajectory grows exponentially in the radial direction. The simulation was terminated when the ion collided with the ring electrode, and the ion energy and time of flight were recorded. The simulation was repeated many times and distributions of the ions as a function of ion collision energy (i.e. the kinetic energy of the ions at the moment of collision) and of the phase of the drive voltage at the moment of collision, and the average number of collisions were evaluated. FIG. 4 shows typical distributions of the ions as a function of ion collision energy for different duty cycle modulation values, m, expressed as a percentage of the total cycle width of the rectangular waveform drive voltage. The work point q in this illustration is set at 0.538 which requires T=3.26 $\mu$s. As can be seen from FIG. 4, for each value of m, the ions are distributed almost uniformly as a function of ion collision energy up to a maximum energy, $E_{max}$. As described by Zhong W et al in "Tandem Fourier Transform Mass Spectrometry Studies of SID of Benzene Monomer and Dimer Ions on a Self-Assembled Fluorinated Alkanethiolate Monolayer Surface", Analytical Chemistry, 1997, vol. 69, pp-2496–2503, the SID process typically requires an ion energy in the range 10–100 eV, and so it follows from FIG. 4 that modulation excitation can provide enough energy for SID to take place in an ion trap device.

Figure 5:
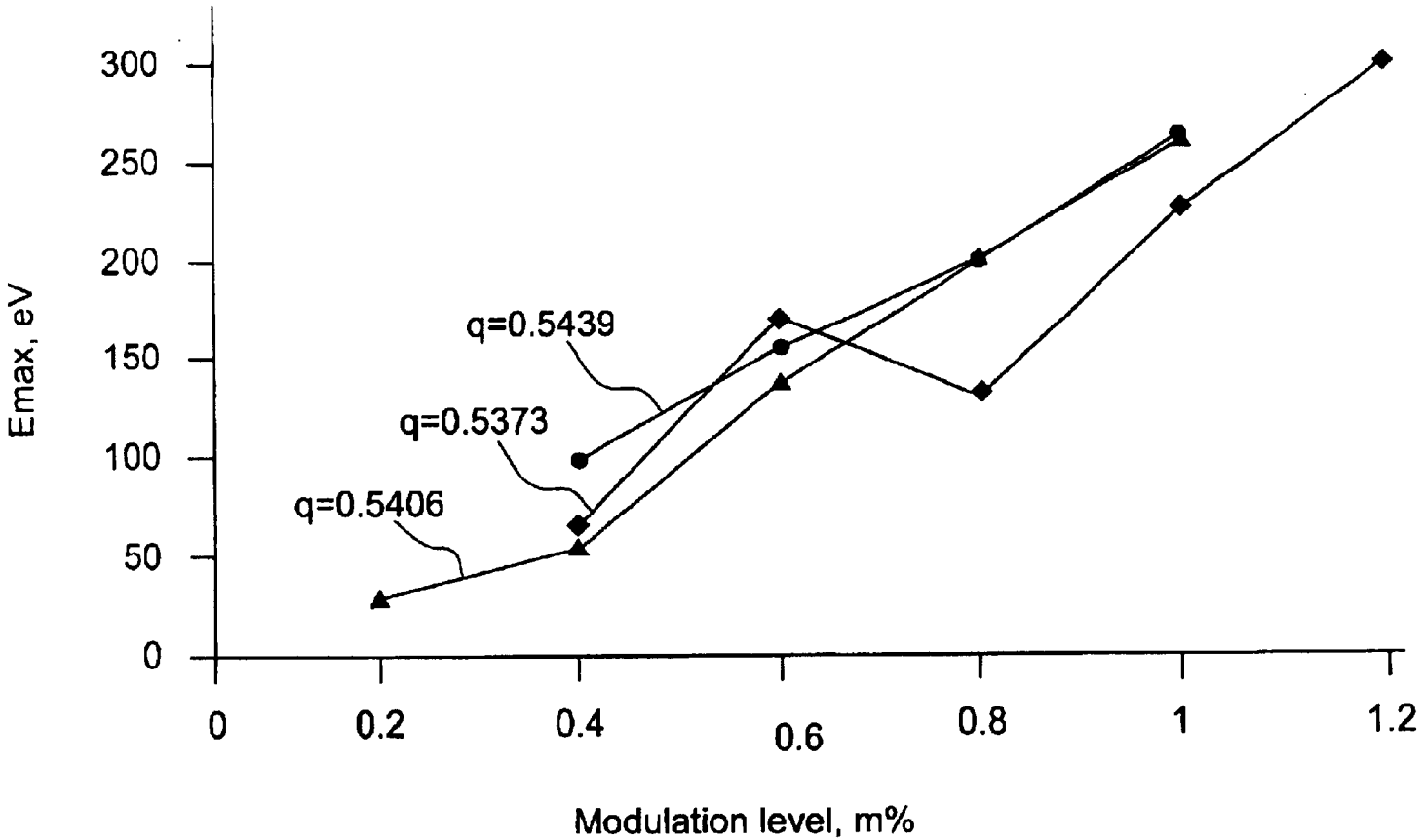
FIG. 5 illustrates the maximum ion energy at the moment of ion collision with a ring electrode as a function of duty cycle modulation m for the A2M waveform, where duty cycle modulation m is expressed as a percentage of the total pulse width of the rectangular waveform drive voltage.
Figure 6:
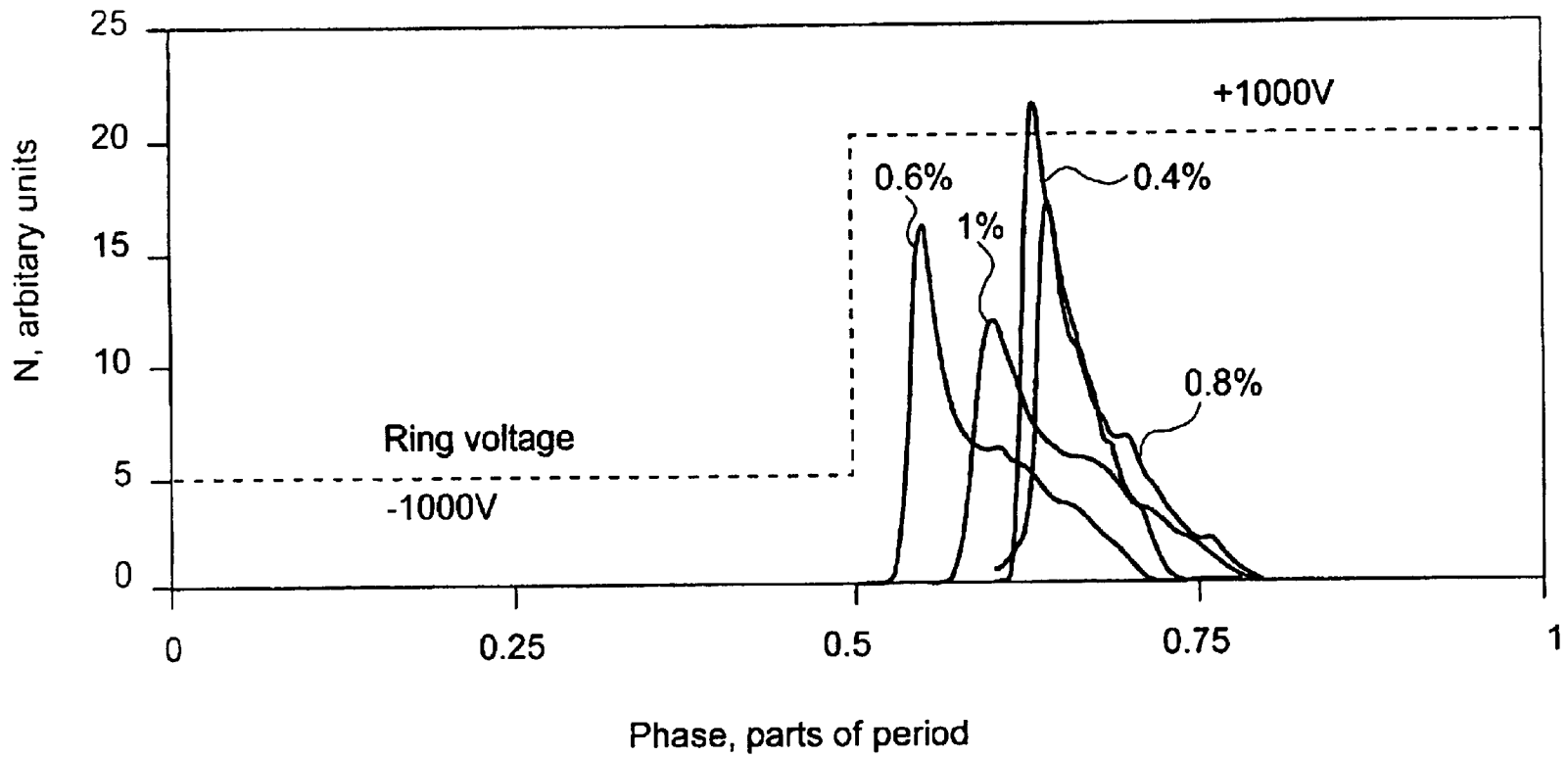
FIG. 6 illustrates distribution of phase of the trapping field at the moment of collision, for a work point q=0.538. The broken line represents the square waveform drive voltage at the ring electrode, and FIGS. 7(*a*) to 7(*c*) illustrate the upper part (i.e. a≧o) of the stability diagram of ion motion in an ion trap device supplied with a rectangular waveform drive voltage having a duty cycle of 0.49, 0.48 and 0.47 respectively. The solid line defines a boundary for stable radial ion motion and the broken line is a scan line.

FIG. 5 shows the maximum ion collision energy ($E_{max}$) as a function of duty cycle modulation value m for several initial work points (i.e. q-values) of the precursor ions. It follows from FIG. 5 that resonance of the radial ion motion will occur provided the duty cycle modulation value exceeds a threshold value $m_t$ which is dictated by collisions of the ions with the buffer gas. This finding is consistent with general experimental data on parametric resonance excitation in a linear ion trap described by Collings, B. A., et al in "Observation of Higher Order Quadrupole Excitation Frequencies in a Linear Ion Trap". J. Am. Soc. Mass Spectrom 2000, vol. 11, pp. 1016–1022. Above the threshold, the maximum ion collision energy $E_{max}$ increases almost linearly with the modulation value m. As an ion approaches the ring electrode it experiences a random number of collisions. The average number of these collisions is proportional to the ion time of flight. Both the flight time and the average number of collisions decreases with increasing modulation. The distribution of the ion's time of flight appears to be a smooth function, but is, in fact, a discrete function. This is because the ion collides with the ring electrode at a particular phase of the drive voltage. The phase of a square waveform drive voltage at the moment of collision may be derived by excluding a whole number of periods from the ion's time of flight. A typical distribution of the ions as a function of RWF phase at the moment of collision for different duty cycle modulation values is shown in FIG. 6. It follows from FIG. 6, that a positively charged ion collides with the ring electrode just before the middle of each positive pulse (or each negative pulse for a negatively charged ion). This particular phase is known to be optimal for the trapping of product ions. Hence product ions that are produced as a result of SID are able to be trapped with the highest efficiency.

Application of a repulsive voltage a fraction of a microsecond after collision is known to improve the efficiency of SID as described by Martin C. D., et al in "Mass spectrometer for molecular structural analysis using surface induced dissociation", PCT Publication No. WO 0077824. The square wave drive voltage changes sign after each half period (typically a few parts of a microsecond). Hence, product ions will be removed from the surface of the ring electrode by repulsion. This is another advantage of using a square waveform drive voltage in conjunction with SID in an ion trap device.

Similar results were obtained using the A4M and A8M waveforms. Quadrupole excitation at lower frequencies gives rise to several additional resonance lines within the stability region and this may cause unwanted ejection of some product ions. In the case of the A2M waveform, the ion trap device will have a considerable mass range for which ion motion is stable permitting the product ions to be trapped, the lower and upper ends of this mass range being defined by the axial resonance bands at $\beta_z$=0.25 and $\beta_z$=0.75 respectively. These resonance bands are compartively weak and simulations show that there is a possibility that when certain threshold conditions are satisfied resonance will not, in fact, occur. In these circumstances, the entire mass range may be available for trapping the product ions.

Radial Instability of the Ion Motion by Means of Boundary Instability

Another method for causing instability of ion motion in the radial direction has been adopted for CID as described by C. Paradisi et al in "Boundary Effects and Collisional Activation in a Quadrupole Ion Trap", Org. Mass Spectrom., 1992, vol. 27, pp 251–254. This method requires application of an additional DC voltage. In this case, the ion trap device no longer operates in a purely RF regime, because the parameter a is non-zero. In this case, the mass range of stable ion motion is limited on the high mass side by the boundary of stability, and the high mass cut-off value is determined by the DC voltage.

By using a rectangular waveform drive voltage it is possible to achieve such conditions without application of any additional voltages, by the use of a duty cycle d<0.5. In this case, the width of the positive pulse is less than that of the negative pulse so that the average voltage of the ring electrode is negative. If the positive and negative amplitudes of the rectangular wave drive voltage are equal i.e. $V_1=-V_2=V_{RF}$, it follows from equations 2 and 3 above that the a and q parameters for all ions will be located on the same "scan line":

$$\frac{a}{q} = \frac{2U}{V} = \frac{1-2d}{2d(1-d)} \tag{4}$$

Figure 7A:
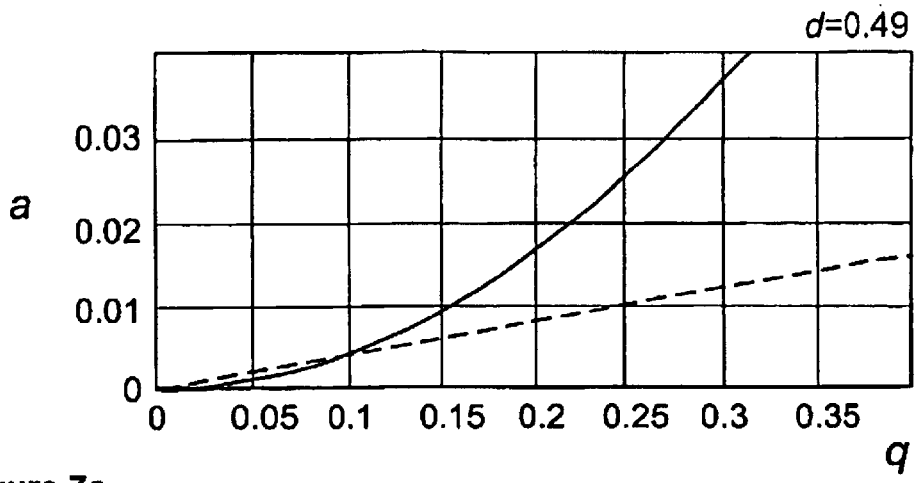
Figure 7B:
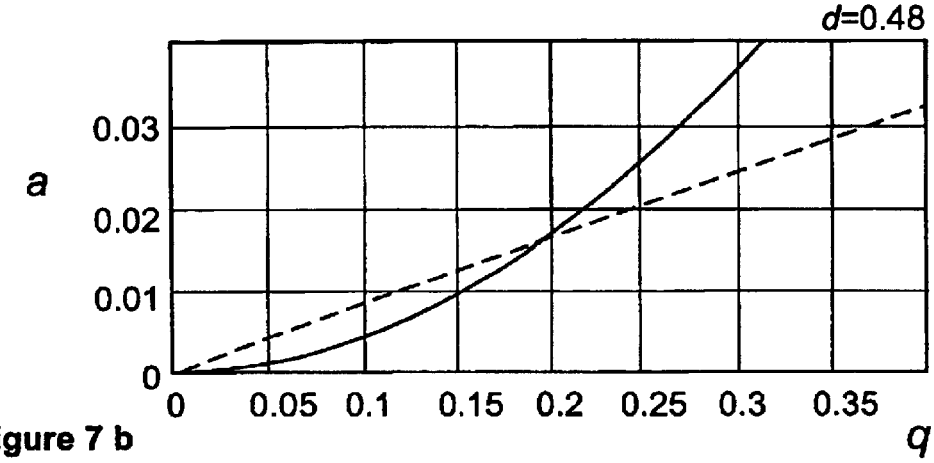
Figure 7C:
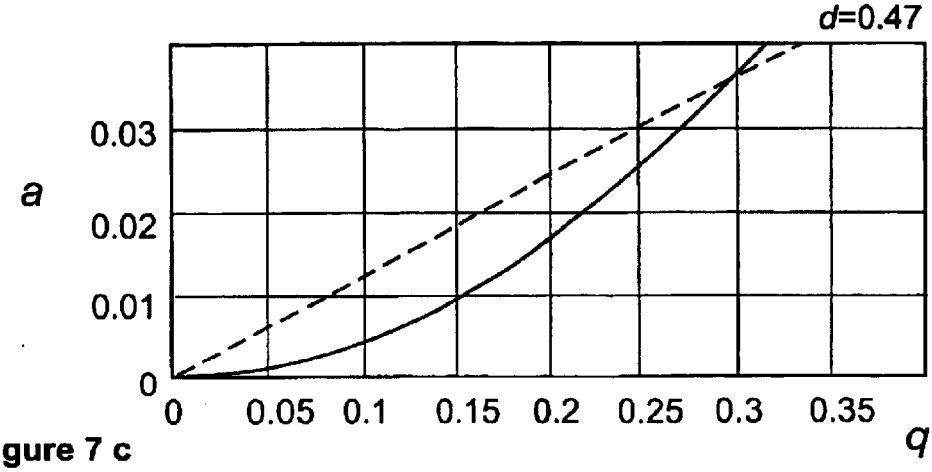

Calculations of stability diagrams for a rectangular waveform drive voltage with d<0.5 are shown in FIGS. 7*a* and 7*c* for different values of d. The position of the scan line (represented by the broken line) is duty cycle dependent. This method of achieving instability of the radial component of ion motion may be used for SID in the ion trap. As before, all unwanted ions are removed from the ion trap and the precursor ion is trapped by square waveform drive voltage. The position of the precursor ion in the stability diagram is determined by its mass and may be easily shifted by a change of trapping frequency. For example, the point q=0.1 may be used as a starting point. Initially, the duty cycle has the value 0.5 and so the precursor ions are located at a point on the RF only line of the (a,q) stability diagram within a region of stable radial ion motion. Then, for positive precursor ions, the duty cycle is rapidly changed to a value less than 0.5, causing the a and q parameters of the ions to shift onto the respective scan line within a region for which the radial component of ion motion is unstable, thereby causing the precursor ions to collide with the ring electrode. In the case of negative precursor ions, the same effect can be achieved by increasing the duty cycle. Under these conditions there exists a mass range for which ion motion is stable enabling product ions to be trapped provided they have a mass-to-charge ratio less than that of the precursor ions.

It will be appreciated that the duty cycle need not have an initial value of 0.5, nor need the voltages $V_1$, $V_2$ be equal. In general, the duty cycle can be changed from any first value for which the precursor ions are located in a region of stable radial ion motion to a second value for which the precursor ions are located in a region of unstable radial ion motion.

In general, the shift of precursor ions from a region of stable ion motion to a region of unstable ion motion can be achieved by imposing a DC component on the quadrupole electric field, by changing the shape (e.g. duty cycle) of a rectangular waveform drive voltage and/or by applying additional DC voltage to the end cap electrodes or to the ring electrodes.

Ion collision energy is dependent on the distance of the ion work point from the stability boundary, which means that it is duty cycle dependent. Simulations show that a typical ion collision energy is a few tens of eV, which is sufficient for SID to take place with reasonable efficiency.

The foregoing demonstrates that it is possible to achieve SID and high efficiency trapping of product ions in a quadrupole ion trap device by means of quadrupole excitation, duty cycle modulation.

TABLE 1

Some low order resonance points in the case of quadrupole excitation in the RF only regime with RWF[1] trapping

| Waveform | Excitation frequency | Resonance line, $\beta_{r,z}$ value | Resonance condition secular frequency | Position in RF line q value: Axial | Position in RF line q value: Radial |
|---|---|---|---|---|---|
| A2M | $\omega_{ex} = \Omega/4$ | 0.25 | $\omega_s = \Omega/8$ | 0.269 | 0.538 |
| | | 0.5 | $\omega_s = \Omega/4$ | 0.500[3] | 1.00[2] |
| | | 0.75 | $\omega_s = 3\Omega/8$ | 0.657 | 1.31[2] |
| A3M | $\omega_{ex} = \Omega/6$ | 0.16667 | $\omega_s = \Omega/12$ | 0.182 | 0.3635 |
| | | 0.33333 | $\omega_s = \Omega/6$ | 0.352[3] | 0.705[3] |
| | | 0.5 | $\omega_s = \Omega/4$ | 0.500 | 1.00[2] |
| A4M | $\omega_{ex} = \Omega/8$ | 0.125 | $\omega_s = \Omega/16$ | 0.137 | 0.2737 |
| | | 0.25 | $\omega_s = \Omega/8$ | 0.269[3] | 0.539[3] |
| | | 0.375 | $\omega_s = 3\Omega/16$ | 0.391 | 0.783[2] |
| | | 0.5 | $\omega_s = \Omega/4$ | 0.500[3] | 1.00[2] |

[1]For duty cycle 0.5 (meandr).
[2]Out of stability range in RF only regime
[3]Resonance is not present because of special excitation waveform

What is claimed is:

1. A method for dissociating precursor ions and for trapping the resultant product ions using a quadrupole ion trap device having a pair of end cap electrodes and a ring electrode, the method including the steps of:

generating a quadrupole electric field to trap said precursor ions in the ion trap device and applying quadrupole excitation to the trapped precursor ions, said quadrupole electric field and said quadrupole excitation being such that the trapped precursor ions are resonantly driven onto the ring electrode where they undergo surface induced dissociation creating said product ions which are then trapped within the ion trap device.

2. The method as claimed in claim 1 wherein said step of generating said quadrupole electric field includes applying a periodic rectangular waveform drive voltage to the ion trap device.

3. The method as claimed in claim 2 wherein said rectangular waveform drive voltage is a square waveform drive voltage.

4. The method as claimed in claim 2 including the step of selecting a drive frequency of said rectangular waveform drive voltage whereby said precursor ions are trapped within the ion trap device.

5. The method as claimed in claim 1 including the step of adjusting said quadrupole electric field before or during application of said quadrupole excitation whereby to enable a radial component of precursor ion motion to attain parametric resonance in response to the quadrupole excitation.

6. The method as claimed in claim 2 wherein said step of applying said quadrupole excitation to said precursor ions is accomplished by periodic duty cycle modulation of said rectangular waveform drive voltage.

7. The method as claimed in claim 6 including the step of adjusting said quadrupole electric field before or during application of said quadrupole excitation so that the value of the q-parameter in a (a,q) stability diagram for ion motion is located at a point where the line at a=o crosses a radial resonance band.

8. The method as claimed in claim 6 wherein said duty cycle modulation of said rectangular waveform drive voltage is an asymmetric modulation whereby a width of each successive $N^{th}$ pulse of a same polarity of the rectangular waveform drive voltage is increased and decreased alternately, where N is an integer greater than 1.

9. The method as claimed in claim 8 wherein said asymmetric modulation is an asymmetrically 2-modulated waveform (A2M).

10. The method as claimed in claim 6 wherein a width of every $N^{th}$ pulse of said rectangular waveform drive voltage is increased or decreased, where N is an integer greater than 1.

11. The method as claimed in claim 2 wherein said step of applying quadrupole excitation to said trapped precursor ions is accomplished by imposing on said rectangular waveform drive voltage a predetermined duty cycle of less than 0.5 for positively charged precursor ions or greater than 0.5 for negatively charged precursor ions, where said duty cycle is defined as being a ratio of a width of the positive excursion of the rectangular waveform drive voltage to the width of a cycle of the rectangular waveform drive voltage, whereby to shift the precursor ions from a region of stable radial ion motion to a region of unstable radial ion motion in a (a,q) stability diagram for ion motion.

12. The method as claimed in claim 6 including the step of controlling a set of switches causing said switches to switch between a high level voltage and a low level voltage whereby to generate said rectangular waveform drive voltage.

13. The method as claimed in claim 2 wherein said step of applying quadrupole excitation to the trapped precursor ions includes applying an additional periodic AC excitation voltage to the quadrupole ion trap device.

14. The method as claimed in claim 1 wherein said step of generating said quadrupole electric field includes applying a sinusoidal waveform drive voltage to the ion trap device and said step of applying quadrupole excitation to the trapped precursor ions includes applying an additional periodic AC excitation voltage to the ion trap device.

15. The method as claimed in claim 14 including the step of selecting the amplitude of said sinusoidal waveform drive voltage whereby said precursor ions are trapped within the ion trap device.

16. The method as claimed in claim 13 including the step of applying said additional periodic AC excitation voltage to the ring electrode of the ion trap device.

17. The method as claimed in claim 13 including the step of applying said additional periodic AC excitation voltage to the end cap electrodes of the ion trap device.

18. The method as claimed in claim 1 wherein the step of generating said quadrupole electric field includes applying a sinusoidal waveform drive voltage to the ion trap device.

19. The method as claimed in claim 18 wherein said step of applying quadrupole excitation to the trapped precursor ions is accomplished by a periodic amplitude or phase modulation of said sinusoidal waveform drive voltage.

20. The method as claimed in claim 1 wherein said step of applying quadrupole excitation to the trapped precursor ions includes imposing a DC component on said quadrupole electric field to shift the precursor ions from a region of stable radial ion motion to a region of unstable radial ion motion in a (a,q) stability diagram for ion motion.

21. The method as claimed in claim 20 wherein said step of imposing said DC component includes applying DC voltage to the ring electrode of the ion trap device.

22. The method as claimed in claim 20 wherein the step of imposing said DC component includes applying DC voltage to the end cap electrodes of the ion trap device.

23. The method as claimed in claim 1 wherein said surface induced dissociation of precursor ions is assisted by a surface treatment of the ring electrode.

24. The method as claimed in claim 1 wherein said surface induced dissociation of precursor ions is assisted by provision of a surface layer on said ring electrode.

25. The method as claimed in claim 24 wherein said surface layer is a gold plated surface layer or an organic monolayer thin film.

26. The method as claimed in claim 1 including the step of causing surface induced dissociation of the trapped productions.

27. A quadrupole ion trap device for trapping product ions formed by dissociation of precursorions, comprising a pair of end cap electrodes, a ring electrode, an ion trapping volume, drive means for generating a quadrupole electric field effective to trap said precursor ions in the ion trapping volume of the ion trap device and excitation means for applying quadrupole excitation to the trapped precursor ions, whereby the trapped precursor ions are resonantly driven onto the ring electrode where they undergo surface induced dissociation creating said product ions which are then trapped in said ion trapping volume.

28. The device as claimed in claim 27 wherein said drive means comprises means for applying a periodic rectangular waveform drive voltage to one or more of said electrodes and said excitation means is arranged to create a duty cycle modulation of said rectangular waveform drive voltage.

29. The device as claimed in claim 28 wherein said duty cycle modulation is an asymmetric duty cycle modulation.

30. The device as claimed in claim 28 wherein said drive means and said excitation means include a set of switches and means for controlling the switches causing said switches to switch between a high level voltage and a low level voltage whereby to generate said rectangular waveform drive voltage and said duty cycle modulation.

31. The device as claimed in claim 30 wherein said drive means comprises means for applying a rectangular waveform drive voltage to one or more of said electrodes and said excitation means is arranged to apply an additional periodic AC excitation voltage to said end cap electrodes or to said ring electrodes.

32. The device as claimed in claim 28 wherein said drive means comprises means for applying a sinusoidal waveform drive voltage to one or more said electrode and said excitation means is arranged to apply an additional periodic AC excitation voltage to said end cap electrode or to said ring electrode.

33. The device as claimed in claim 28 wherein said ring electrode has a surface layer for assisting said dissociation of said precursor ions.

34. The device as claimed in claim 33 wherein said surface layer is gold plated.

35. The device as claimed in claim 32 wherein said ring electrode is plated with an organic monolayer thin film.

36. A tandem mass spectrometry apparatus including a quadrupole ion trap device according to claim 27 and means for analyzing product ions ejected from the ion trap device.

* * * * *